US010758956B2

(12) United States Patent
Colosseo et al.

(10) Patent No.: US 10,758,956 B2
(45) Date of Patent: Sep. 1, 2020

(54) METHOD FOR ROLLING METAL SHEETS WITH VARIABLE THICKNESS

(71) Applicant: C.R.F. Societa Consortile per Azioni, Orbassano (Turin) (IT)

(72) Inventors: Marco Colosseo, Orbassano (IT); Daniele Bassan, Orbassano (IT)

(73) Assignee: C.R.F. Società Consortile per Azioni, Orbassano (Turin) (IT)

( * ) Notice: Subject to any disclaimer, the term of this patent is extended or adjusted under 35 U.S.C. 154(b) by 653 days.

(21) Appl. No.: 15/421,542

(22) Filed: Feb. 1, 2017

(65) Prior Publication Data

US 2017/0225208 A1 Aug. 10, 2017

(30) Foreign Application Priority Data

Feb. 4, 2016 (IT) ..... 102016000011482

(51) Int. Cl.
*B21B 1/12* (2006.01)
*B21H 8/02* (2006.01)
(Continued)

(52) U.S. Cl.
CPC ..... *B21B 1/12* (2013.01); *B21B 1/227* (2013.01); *B21B 1/24* (2013.01); *B21B 27/021* (2013.01); *B21H 8/005* (2013.01); *B21H 8/02* (2013.01); *B21B 2205/02* (2013.01); *B21B 2261/043* (2013.01); *B21B 2261/046* (2013.01)

(58) Field of Classification Search
CPC ..... B21B 1/0805; B21B 1/22; B21B 13/00; B21B 27/02; B21B 27/021; B21B 27/028; B21B 37/24; B21B 2205/00; B21B 2205/02; B21B 2205/04; B21B 2261/043; B21B 2261/046; B21B 1/227; B21B 1/12; B21B 1/24; B21B 27/005; B21H 8/00; B21H 8/02; B21H 8/005; B21D 53/88
See application file for complete search history.

(56) References Cited

U.S. PATENT DOCUMENTS 1,106,172 A * 8/1914 Wetcke ..... B21B 1/24 72/187
2,639,660 A 5/1953 Sunderhauf
(Continued)

FOREIGN PATENT DOCUMENTS

DE 10103487 A1 8/2002
DE 102011001320 A1 10/2012
(Continued)

OTHER PUBLICATIONS

Translation; JP 61-86002A, Jan. 1986.*
(Continued)

*Primary Examiner* — Edward T Tolan
(74) *Attorney, Agent, or Firm* — RMCK Law Group, PLC

(57) ABSTRACT

Described herein is a method for rolling metal sheets of variable thickness. The method makes it possible to impress, during rolling, any distribution of areas of increased thickness within a figure corresponding to the plane development of a motor-vehicle component prior to the pressing operation. Impression of the desired distribution of areas of increased thickness envisages simultaneous impression, during rolling, of a further distribution of areas of increased thickness, or compensation areas.

11 Claims, 7 Drawing Sheets

(51) Int. Cl.

| | |
|---|---|
| ***B21H 8/00*** | (2006.01) |
| ***B21B 1/22*** | (2006.01) |
| ***B21B 1/24*** | (2006.01) |
| ***B21B 27/02*** | (2006.01) |

(56) References Cited

U.S. PATENT DOCUMENTS 3,488,988 A * 1/1970 Christine ..... B21B 1/227 428/573
5,042,711 A * 8/1991 Iskenderian ..... B21B 1/0805 219/102
5,215,245 A 6/1993 Moyer
5,890,389 A * 4/1999 Ohba ..... B21B 1/0805 72/234
2004/0107757 A1* 6/2004 Arns ..... C21D 1/673 72/185
2005/0244667 A1* 11/2005 Hauger ..... B23K 26/26 428/600
2008/0211264 A1* 9/2008 Riess ..... B62D 25/04 296/193.01
2010/0199737 A1* 8/2010 Pellmann ..... B21D 28/06 72/203
2012/0328899 A1* 12/2012 Becker ..... B21B 1/22 428/600
2014/0367000 A1* 12/2014 Kamat ..... B22D 21/04 148/551
2015/0298186 A1* 10/2015 Zhang ..... B21B 37/16 72/240
2016/0271663 A1* 9/2016 Memili ..... B21B 1/22
2016/0375473 A1* 12/2016 Champion ..... B22D 11/009 428/600
2017/0029918 A1* 2/2017 Panier ..... C21D 8/0236
2017/0182533 A1* 6/2017 Lee ..... B21H 8/005
2017/0348746 A1* 12/2017 Polk ..... B21B 1/0805
2018/0272399 A1* 9/2018 Sikora ..... B32B 15/01

FOREIGN PATENT DOCUMENTS

DE 102014201611 A1 7/2015
EP 2047922 A1 * 4/2009 ..... B21D 53/88
EP 20111937 A1 10/2009
JP 60-244435 A * 12/1985 ..... B21H 8/00
JP 61-86002 A * 1/1986 ..... B21B 1/22

OTHER PUBLICATIONS

Translation, EP 2047922 A1; Apr. 2009.*
Search Report dated Oct. 11, 2016, for Italian Publication No. IT UB20160442, 3 pages.

* cited by examiner

METHOD FOR ROLLING METAL SHEETS WITH VARIABLE THICKNESS

CROSS REFERENCE TO RELATED APPLICATIONS

This application claims priority to Italian Patent Application No. 102016000011482 filed on Feb. 4, 2016, the entire disclosure of which is incorporated herein by reference.

FIELD OF THE INVENTION

The present invention relates to methods for rolling metal sheets with variable thickness, in particular for the subsequent operation of pressing of motor-vehicle components (bodywork and frame).

PRIOR ART

Known in the art are numerous methods for rolling metal sheets with variable thickness to obtain sheet-metal blanks known by the name of "tailored rolled blanks".

These are in general metal sheets having a band-wise differentiated thickness. By the term "band-wise differentiated thickness" it is meant to indicate a configuration in which the gradient of thickness is substantially unidirectional along the metal sheet. In other words, the thickness varies along only one direction on the metal sheet itself (typically the direction transverse to the bands), which features transverse bands rolled to a nominal thickness alternating with transverse bands rolled to an increased thickness. Each transverse band develops throughout the width of the metal sheet and in a direction orthogonal to the direction of rolling.

Likewise known in the art is the need to provide, on sheet-metal components for the bodywork or for the frame of a motor vehicle, localised areas with increased thickness in order to improve the structural strength in areas subject to more intense stresses. This generally imposes the adoption of two choices:

i) use of welded starting metal sheets with variable thickness (the so-called "tailored welded blanks"); and ii) use of starting metal sheets with variable thickness obtained by band-wise rolling of the same.

As regards the first solution, even though it is today rather widely adopted, it is characterized by the drawback—that cannot be eliminated—inherent in the welding bead, which in the long term is exposed to phenomena of degradation that do not affect metal sheets of variable thicknesses made in a single piece. Furthermore, the metal sheets of variable thickness are welded by aligning the faces of two contiguous portions to a reference plane, inevitably providing a markedly "steplike" appearance on the surface of the metal sheet. This may constitute a problem in case of metal sheets of variable thickness on which a finishing metal sheet (for example, a skin metal sheet of the door of a motor vehicle) must subsequently be hemmed.

Apart from this, even though the welding process by which the metal sheets in question are obtained may envisage departing from a traditional distribution of thicknesses band-wise variable, in practice the complications introduced at the level of process of production of metal sheets render the option far from viable.

As regards the second solution, even though it does not present the aforementioned drawbacks in so far as the metal sheet is made in a single piece, it is characterized by an intrinsic constraint inherent in band-wise rolling. In other words, in circumstances that would require provision of a circumscribed and localised area of increased thickness, it is required to provide an entire band of increased thickness that covers the area in question since the starting metal sheet does not allow otherwise (with evident increase in weight and cost).

In either case, it may moreover happen that the band of increased thickness presents a boundary/welding line (for a tailored welded blank) or an area of thickness transition (for a tailored rolled blank) that is located in an area that remains visible in the finished vehicle. Examples of such areas may be constituted by the frame of a window obtained integrally with the "skeleton" (structural) metal sheet of the door of a motor vehicle. The "skeleton" metal sheet generally has an area of reinforcement of increased thickness in a hinge area where the hinges that couple the door to the body of the vehicle are fixed.

An area of increased thickness would be in itself strictly necessary only in the hinge area, without involving—for example—the frame of the window. However, rolling (or welding) to obtain blanks with band-wise differentiated thickness actually leads to having an area of increased thickness also at the root of the window frame, which normally remains visible also on the finished vehicle. It should be noted, amongst other things, that the door of a motor vehicle is precisely one of the components that undergoes hemming of the metal sheets, so that the acceptance of compromises on the positioning of welding joints or areas of transition constitutes an evidently undesirable condition in the light of what has been set forth above.

OBJECT OF THE INVENTION

The object of the invention is to overcome the technical problems mentioned previously. In particular, the object of the invention is to provide a method for rolling metal sheets with variable thicknesses in which the areas of increased thickness may have any geometry, extension, and orientation, departing from the traditional band-wise rolling process.

SUMMARY OF THE INVENTION

The object of the invention is achieved by a method having the features forming the subject of the appended claims, which form an integral part of the technical disclosure provided herein in relation to the invention.

In particular, the object of the invention is achieved by a method for rolling metal sheets with variable thickness, the method including:

determining a first distribution of areas having an increased thickness with respect to a nominal rolling thickness of the sheet, said first distribution of areas including one or more areas, determining, for each area of said first distribution, an increase of volume of material corresponding to the difference between the volume of material underlying each area with the thickness assigned on the basis of said first distribution, and the volume of material underlying the corresponding area with the nominal rolling thickness, determining a second distribution of areas having an increased thickness with respect to the nominal rolling thickness, wherein said second distribution of areas includes one or more areas, assigning, to each area of said second distribution an increase of volume of material corresponding to the difference between the volume of material underlying each area with the thickness assigned on the basis of said second distribution, and the volume of material underlying the corresponding area with the nominal rolling thickness, wherein the overall increase of volume of the one or more areas of said second distribution is equal or higher to the overall increase of volume of the one or more areas of said first distribution, positioning the one or more areas of said first distribution along said sheet in a desired position within a figure that corresponds to a plane development of a component of a motor-vehicle which is to undergo a pressing operation, positioning the one or more areas of said second distribution outside of said figure, providing a pair of mill rolls having a surface relief that corresponds, developed on a plane, to the combination of the first and the second distribution of areas with increased thickness, and rolling said metal sheet by means of said pair of mill rolls.

SUMMARY OF THE DRAWINGS

The invention will now be described with reference to the annexed figures, provided purely by way of non-limiting example, wherein.

DETAILED DESCRIPTION OF PREFERRED EMBODIMENTS OF THE INVENTION

Figure 1:
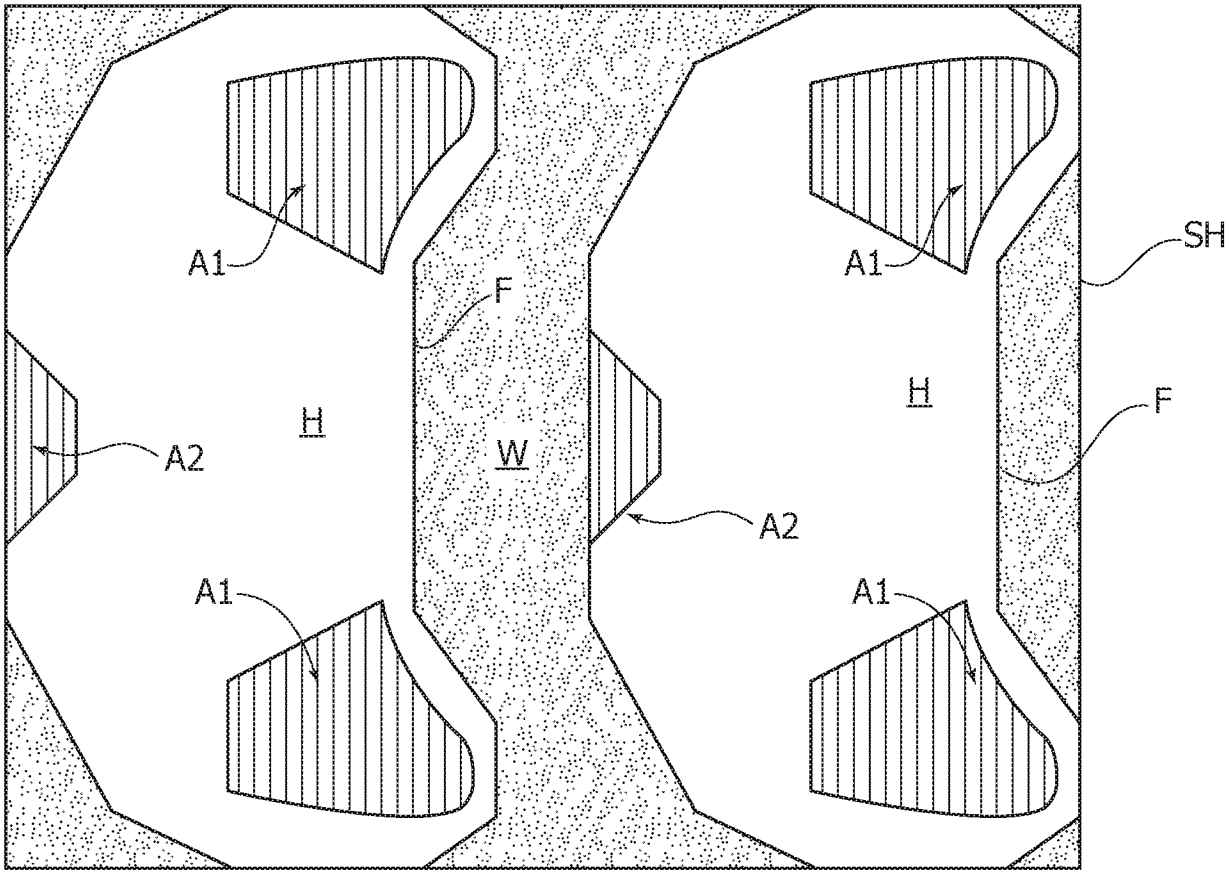
FIG. 1 is a schematic view of a metal sheet presenting a figure corresponding to the plane development of a motor-vehicle component and areas of increased thickness distributed over the component.

FIG. 1 illustrates a metal sheet SH in top plan view, appearing on which are the perimeters of two figures F corresponding to the plane development of a motor-vehicle component that is obtained by pressing a fraction of the metal sheet SH obtained by shearing, along its perimeter, the figure F, which in this case corresponds to the bonnet H of a motor vehicle.

To satisfy the requirements of structural strength and stiffness, the bonnet H must be made with areas of reinforcement localised in the areas that are subject to the heaviest structural loads. These areas may be identified with the fixing areas of the hinges for opening of the bonnet, which are designated by A1, and the area where a lock of the bonnet itself is located, this area being designated by A2.

The area comprised between the figures F is denoted by the letter W and corresponds to a scrap area, which is—by definition—positioned outside the figures, i.e., outside the perimeter of the figures F.

The areas A1 and A2 are areas having an increased thickness with respect to a nominal rolling thickness of the metal sheets. By way of example, in the embodiment illustrated in FIG. 1 the areas A1 and A2 have a rolling thickness of 1 mm, whereas the remaining part of the figure F has a (nominal) rolling thickness of 0.55 mm.

Formation of the areas A1 and A2 by means of a rolling method according to the invention first of all calls for some preliminary considerations.

i) The provision of a distribution of areas of increased thickness first of all envisages having available mill rolls the surface relief of which corresponds, developed in a plane, to the distribution of the areas A1 and A2. Basically, the rolls must have recessed portions of a size and shape corresponding to those of the areas A1 and A2, and of a depth such as to provide the required thickness on the metal sheet SH.

ii) In addition to the foregoing, an important fact should be noted: the creation of areas (or "patches") of a thickness increased with respect to the nominal rolling thickness is equivalent to introducing local gradients of the flow rate of the material that is being rolled. In particular, the flow of material undergoes a deceleration in areas of increased thickness, a fact that may create serious problems of distortion (or even failure) of the metal sheets. Evidently, the problem is particularly felt in the region of interface between each area A1, A2 and the remainder of the figure F.

iii) It follows that the sole measure referred to in point i) is not per se sufficient to implement the method according to the invention. There should be envisaged a further distribution of areas of increased thickness that substantially correspond to areas wherein the material flow having a higher rate than the flow coming from the areas with increased thickness can lead out to, thus slowing down and practically equalling its own rate of advance to that of the neighbouring flows of material. The areas of increased thickness of the second distribution are arranged in positions that lie outside the figure F, in so far as they do not form part of the finished component. They are simply eliminated with the scrap and have the sole purpose of preventing any distortion or failure of the metal sheet during rolling.

iv) The further distribution of areas with variable thickness is determined on the basis of a criterion of equality of volumes of material. In particular, if $V'_i$ is the volume of material underlying each of the areas A1 and A2 with the increased thickness, and $V0'_i$ is the volume underlying each of the same areas but considered with nominal thickness (i.e., the volume that would underlie them if rolling were to be performed with nominal thickness), the increase in volume of material $\Delta V_i$ associated to each i-th area may be expressed as $$\Delta V'_i = V'_1 - V0'_i$$

Hence, the overall increase in volume is equal to the summation of all the increases $\Delta V_i$, with the index i that ranges from by 1 to the number of areas with increased thickness.

The criterion of sizing of the areas of the further distribution envisages that the overall increase in volume associated to them be equal to or greater than the overall increase in volume of the areas of increased thickness of the first distribution. In particular, if $V''_j$ is the volume of material underlying each of the areas of the second distribution with the respective increased thickness, and if $V0''_j$ is the volume underlying each of the same areas but considered with nominal thickness, the increase in volume of material $\Delta V''_j$ associated to each j-th area may be expressed as $$\times V''_j = V''_j - V0''_j$$

with $$\Delta V''_{TOT} \geq \Delta V_{TOT}$$

The above criterion is chosen on the basis of a conservative logic: the surplus in the increase in volume of the areas of the second distribution is chosen so as to ensure a safety margin that enables the material in the faster flows to slow down and expand in the most favourable conditions possible.

To sum up, the method according to the invention includes the following steps:

- determining a first distribution of areas of a thickness increased with respect to a nominal rolling thickness of the metal sheet, in which the distribution of areas includes one or more areas;
- determining, for each area of the first distribution, an increase in volume of material corresponding to the difference between the volume of material underlying each area, with the thickness assigned according to said first distribution, and the volume of material underlying the corresponding area, with the nominal rolling thickness;
- determining a second distribution of areas of a thickness increased with respect to the nominal rolling thickness, in which the second distribution includes one or more areas;
- assigning, to each area of said second distribution, an increase in volume of material corresponding to the difference between the volume of material underlying each area with the thickness assigned according to said second distribution, and the volume of material underlying the corresponding area with the nominal rolling thickness, in which the overall increase in volume of the one or more areas of the second distribution is equal to or greater than the overall increase in volume of the one or more areas of the first distribution;
- positioning the one or more areas of the first distribution along the metal sheet SH in desired positions within a figure F that corresponds to a plane development of a motor-vehicle component that is to undergo the pressing operation;
- positioning the one or more areas of the second distribution on the outside of the figure F; and
- providing a pair of mill rolls having a surface relief that corresponds, developed in a plane, to the combination of the first and second distributions, and rolling the metal sheet SH by means of the aforesaid pair of mill rolls.

The first distribution of areas may coincide or not with the distribution of areas A1, A2 previously described, which is a theoretical distribution.

Figure 2:
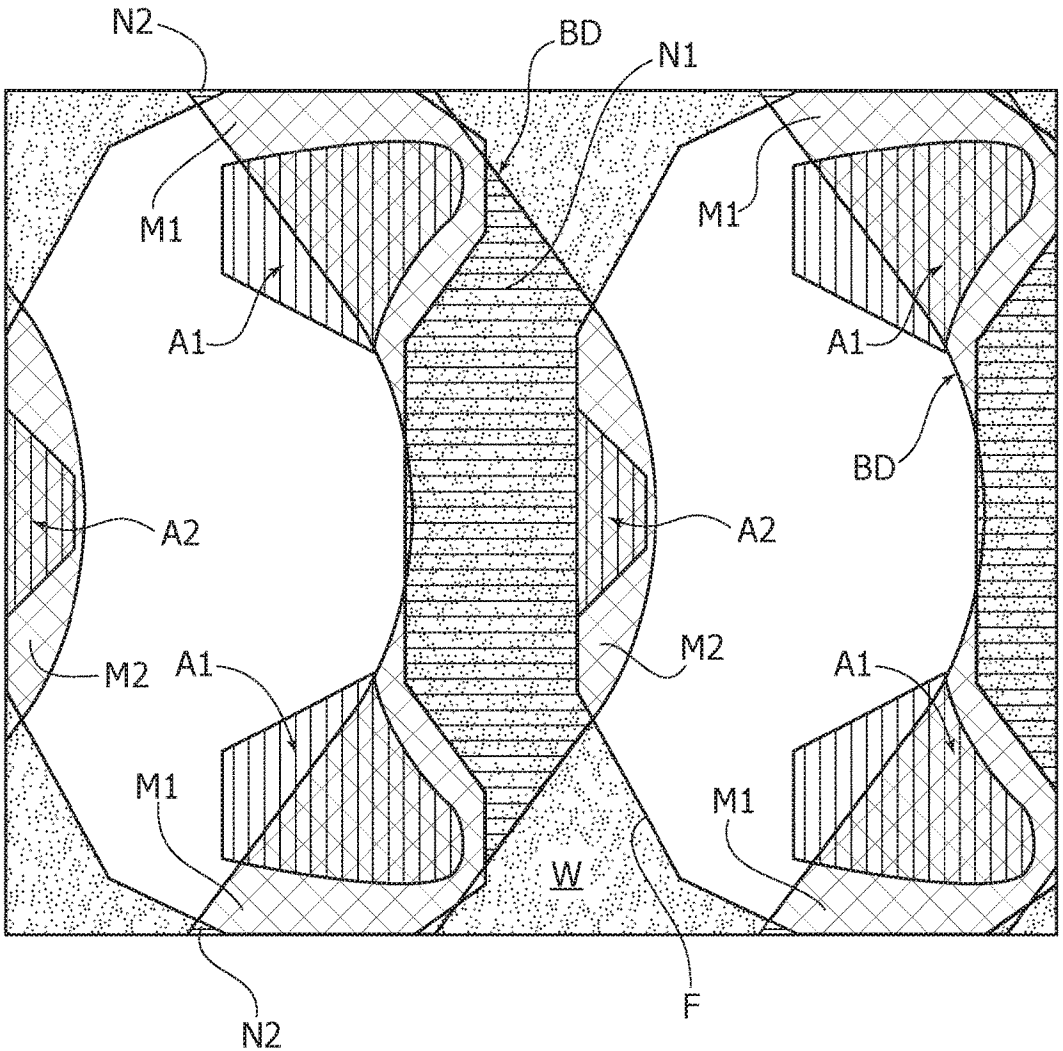
FIG. 2 is a schematic view of a first embodiment of the method according to the invention, here illustrated implemented on the component of FIG. 1.

With reference to FIG. 2, in a first embodiment of the method according to the invention, the first and second distributions of areas of increased thickness form part of a single area of increased thickness and shaped like a C or like a boomerang and are designated by the reference BD. It should be noted that the area BD is not a simple transverse band as in the case of known rolling methods, but has a shape that gives rise to a domain non-which is not simply connected (i.e., a domain in which there exists at least one line joining two points of the domain that is not internal to the domain itself). In this embodiment there may be noted:

- the areas A1 and A2 represented with vertical hatching;
- the areas of the first distribution, denoted by the references M1 (for the areas corresponding to the regions of attachment of the bonnet hinges H, i.e., in the areas A1) and M2 (for the area corresponding to the lock, i.e., in the area A2; the areas in question are represented with oblique hatching, and certain points overlap the hatching corresponding to the areas A1 and A2; and
- the areas of the second distribution, denoted by the references N1 and N2 according to their position along the metal sheet SH, which are represented with horizontal hatching.

As may be noted, this embodiment corresponds to a simplified version of the method, in which the areas A1 and A2 are approximated with portions of a simpler geometry (the area BD), and in which there is no interruption between the areas of the first and second distributions.

The areas comprised between successive areas BD have, instead, a thickness equal to the nominal rolling thickness (by way of example the previous reference values may be assumed: 0.55 mm for the nominal thickness, 1 mm for the increased thickness).

During rolling, the material with faster flow rate comprised between the areas N2 can flow out into the area N1, likewise creating optimal conditions for the subsequent creation of the area M2.

Figure 2A:
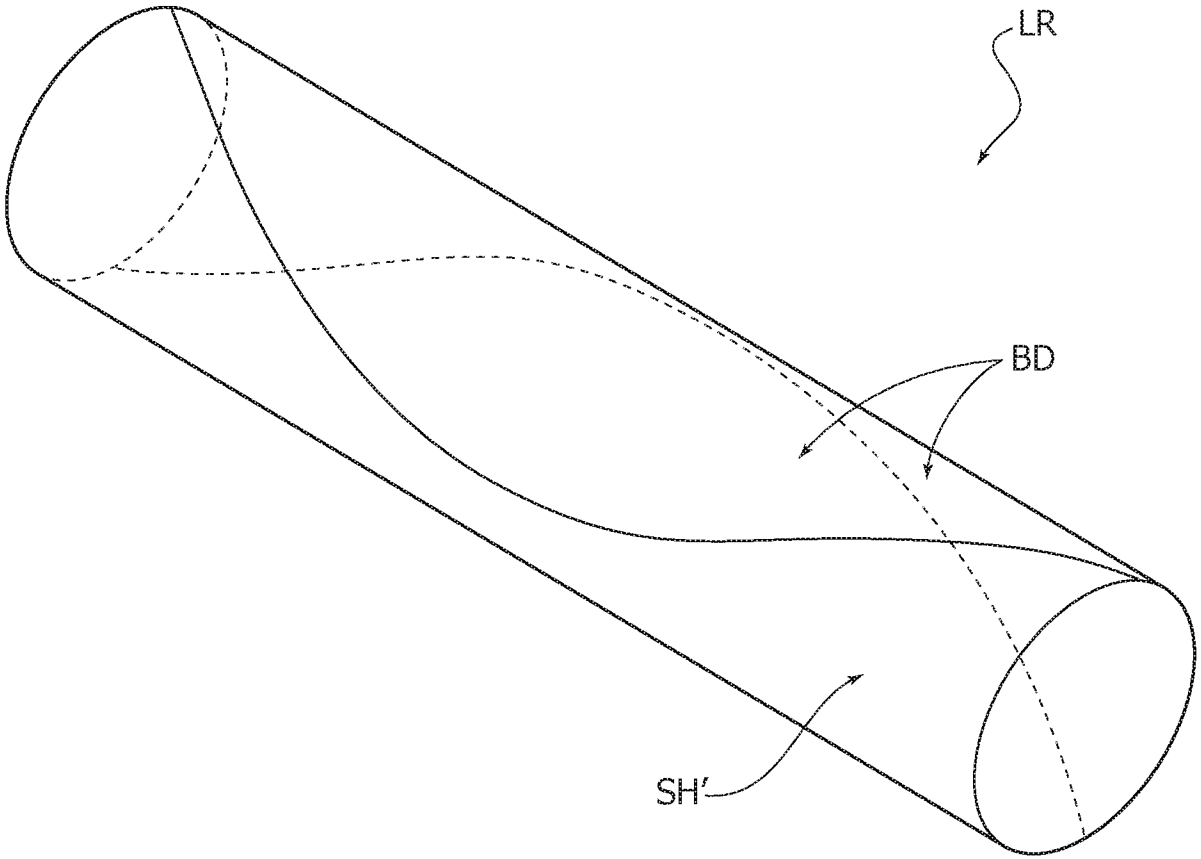
FIG. 2A is a schematic perspective view of a mill roll used for implementation of the method of FIG. 2.

The embodiment in question enables considerable simplification of the construction of the rolls. In this connection, reference may be made to the subsequent FIG. 2A, where the reference LR designates a roll of the pair used for rolling the metal sheet SH. The roll simply has a surface recessed portion the plane development of which corresponds to the area BD (for this reason, the same reference number is used), whilst the rest of the roll LR—all at a greater radial distance from the axis of the roll LR itself—carries out rolling of the remaining part of metal sheet SH with the nominal thickness. The sequence of impressions corresponding to the area BD on the metal sheet SH is due—as is obvious—to the periodicity with which the roll presents its own surface to the metal sheet. It is likewise a preferred solution in the case where the number of areas A1, A2 is so high as to render technologically too expensive and complex the production of rolls with surface relief that performs the corresponding first and second distributions of areas.

The shape of the area BD enables identification of two peripheral areas—corresponding to the areas M1—that are located in the desired position within the figure F, and an intermediate area—corresponding to the area N1—that is very suited to fall between two adjacent figures F, likewise defining an overlapping with the subsequent figure F to obtain the area M2.

The following equation in any case applies:

$$\Delta V''_{TOT} = (V''_{N1} - V0''_{N1}) + (V''_{N2} - V0''_{N2}) \geq \Delta V'_{TOT} = (V'_{M1} - V0'_{M1}) + (V'_{M2} - V0'_{M2})$$

where:

$\Delta V'_{TOT}$ is the overall increase in volume of the first distribution; and $\Delta V''_{TOT}$ is the overall increase in volume of the second distribution. The index i spans the areas M1, M2, and the index j spans the areas N1, N2.

Figure 3:
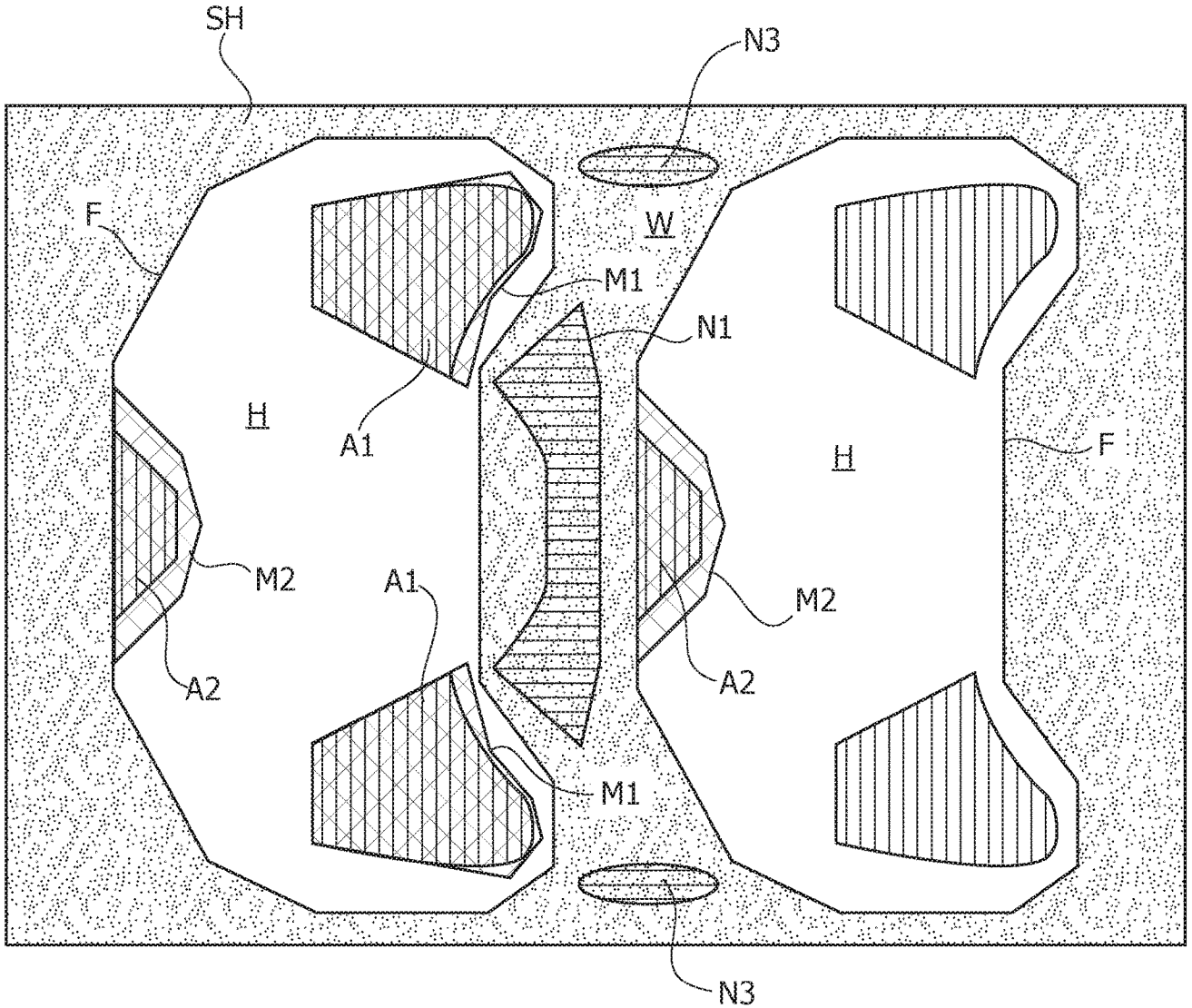
FIG. 3 is a schematic view of a second embodiment of the method according to the invention, once again illustrated implemented on the component of FIG. 1.

With reference to FIG. 3, a second embodiment of the method according to the invention will now be described. In the embodiment of FIG. 3, the first distribution of areas of increased thickness M1, M2 and the second distribution of areas of increased thickness N1, N3 are separate and distinct from one another.

It may moreover be noted that the areas M1, M2 are here illustrated slightly larger than the theoretical areas A1, A2, but it should be borne in mind that it is possible to render them identical, of course with a corresponding compensation made on the areas N1, N3 according to the criterion referred to above. Enlargement of the areas M1, M2 with respect to the theoretical areas A1 and A2 may become necessary, for example, for technological reasons, such as the maximum amount of material that can be displaced per unit area in the rolling process (squeezing gradient).

The surface relief of each of the rolls of the pair that carries out the process according to FIG. 3 corresponds to a distribution of recesses specular to the distribution of areas at the centre of FIG. 3 (M1, M2, N1, N3). During rolling, assuming that the areas M1 are the first to be obtained (not necessarily this corresponds to reality; here, this assumption has merely illustrative purposes), the rate of flow of material of the metal sheet SH during rolling is slower in the peripheral areas, corresponding to the areas M1, whereas it is faster in the central area, which has a nominal thickness.

The material in the central area can then flow out, slowing down its rate, into the area N1, which is defined by mating between two complementary semi-cavities present on the two rolls. Immediately after, the area M2 is created in the central position, and in a practically simultaneous way a deceleration of the flow is obtained in the peripheral position thanks to the areas N3, which are once again defined by mating between two complementary semi-cavities present on the two rolls. The process then repeats in a periodic way.

As in the previous case, the following equation applies:

$$\Delta V''_{TOT}=(V''_{N1}-V0''_{N1})+(V''_{N3}-V0''_{N3})\geq\Delta V'_{TOT}=(V'_{M1}-V0'_{M1})+(V'_{M2}-V0'_{M2})$$

where:

$\Delta V'_{TOT}$ is the overall increase in volume of the first distribution; and $\Delta V''_{TOT}$ is the overall increase in volume of the second distribution. The index i spans the areas M1, M2, and the index j spans the areas N1, N3.

Figure 4:
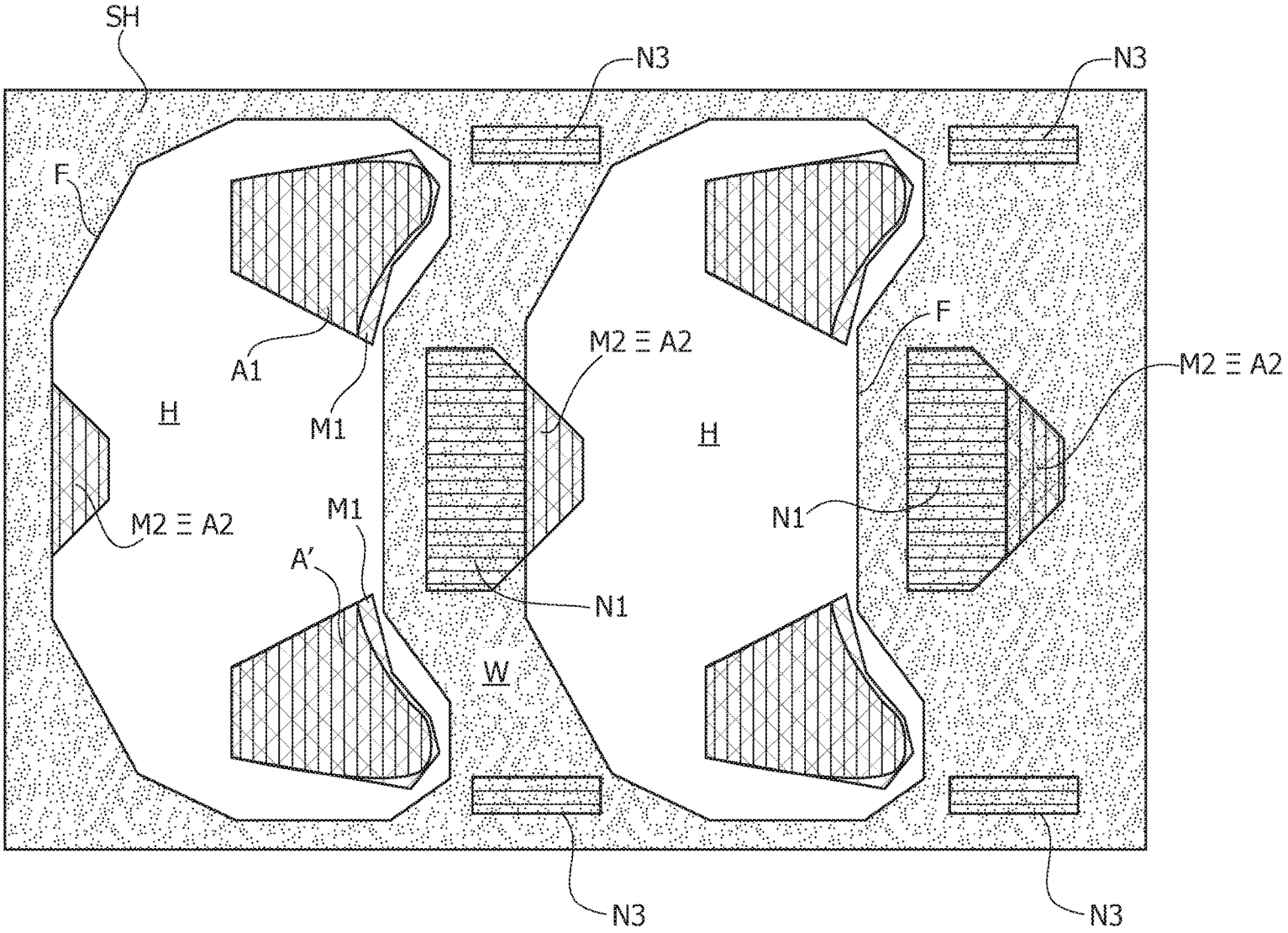
FIG. 4 is a schematic view of a third embodiment of the method according to the invention, once again illustrated implemented on the component of FIG. 1.

With reference to FIG. 4, a third embodiment of the method according to the invention will now be described. The embodiment of FIG. 4 corresponds to a sort of hybrid solution between the first and second embodiments. There coexist both a merged form where the first and second distributions overlap (areas N1 and M2) and a separate form where the first and second distributions are distinct (areas M1 and N3). In this case—it is to be noted—the area M2 is illustrated as coinciding with the theoretical area A2, whereas for the areas M1 the observation made previously applies.

The surface relief of each of the rolls of the pair that implements the method according to FIG. 4 corresponds to a distribution of recessed portions specular to the distribution of areas at the centre of FIG. 3 (M1, M2, N1, N3).

During rolling, assuming that the areas M1 are the first to be obtained (not necessarily this corresponds to reality; here, this assumption has merely illustrative purposes), the rate of flow material of the metal sheet SH during rolling is slower in the peripheral areas, corresponding to the areas M1, whereas it is faster in the central area, which has a nominal thickness.

The material in the central area can thus flow out, slowing down its rate, into the area N1, which is defined by mating between two complementary semi-cavities present on the two rolls. Immediately after, the area M2 is created in the central position, and in a practically simultaneous way a deceleration of the flow in the peripheral position is obtained thanks to the areas N3, once again defined by mating between two complementary semi-cavities present on the two rolls. Without solution of continuity, and during completion of the area N3, the area M2 is created.

The process then repeats in a periodic way.

As before, the following relation applies:

$$\Delta V''_{TOT}=(V''_{N1}-V0''_{N1})+(V''_{N3}-V0''_{N3})\geq\Delta V'_{TOT}=(V'_{M1}-V0'_{M1})+(V'_{M2}-V0'_{M2})$$

where:

$\Delta V'_{TOT}$ is the overall increase in volume of the first distribution; and $\Delta V''_{TOT}$ is the overall increase in volume of the second distribution. The index i spans the areas M1, M2, and the index j spans the areas N1, N3.

Figure 5:
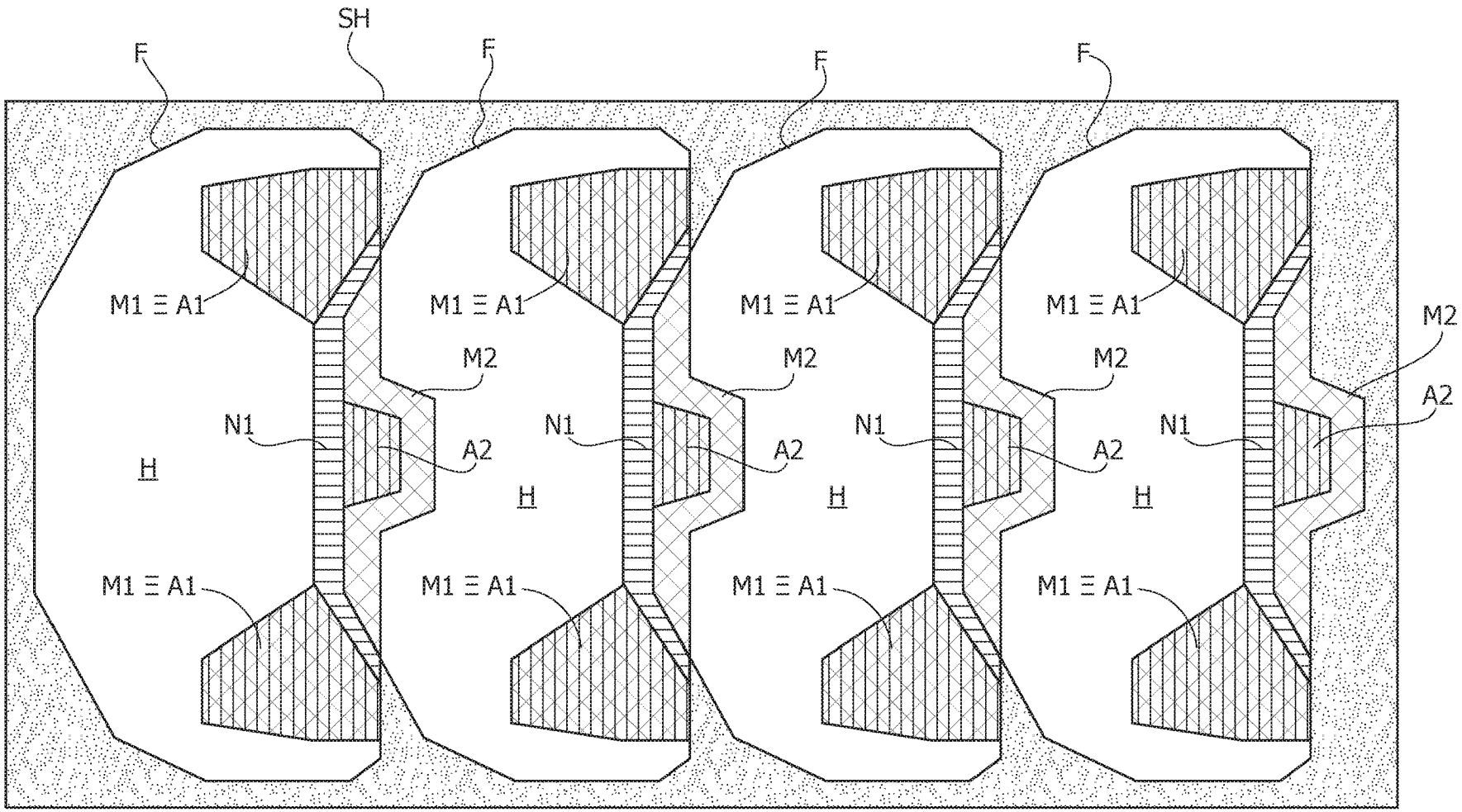
FIG. 5 is a schematic view of a fourth embodiment of the method according to the invention, once again illustrated implemented on the component of FIG. 1.

With reference to FIG. 5, a fourth embodiment of the method according to the invention will now be described. The embodiment of FIG. 5 substantially consists of a variant of the embodiment of FIG. 2, where the band BD is, however, replaced by a polygonal figure of complex perimeter constituted by broken lines. The shape as a whole resembles a C, and again there is no interruption between the first distribution and the second distribution. It should be noted, however, that unlike FIG. 2 the extension of the impression that covers both distributions is less than the width of the metal sheet SH.

The first distribution of areas of increased thickness includes in this case two areas M1 in the regions of fixing of the bonnet hinges H (here illustrated substantially as having the same area as the corresponding theoretical area A1) and an area M2 corresponding to the lock of the bonnet H, which larger than the theoretical area A2.

The increase in volume of both areas is compensated for by a single area N1 that forms part of the second distribution (itself defining this distribution), and that—like the area N1 of FIG. 2—is located in the area of waste W between two successive figures F. Each impression shown hatched in FIG. 5 represents the envelope of the surface relief on the pair of rolls. The impression is obviously defined by causing mating of a pair of semi-cavities (and not projections, it being necessary to create an increase in thickness).

In this case, the following relation applies:

$$\Delta V''_{TOT}=(V''_{N1}-V0''_{N1})\geq\Delta V'_{TOT}=(V'_{M1}-V0'_{M1})+(V'_{M2}-V0'_{M2})$$

where:

$\Delta V'_{TOT}$ is the overall increase in volume of the first distribution; and $\Delta V''_{TOT}$ is the overall increase in volume of the second distribution. The index i spans the areas M1, M2, and the index j spans the area N1.

Figure 6:
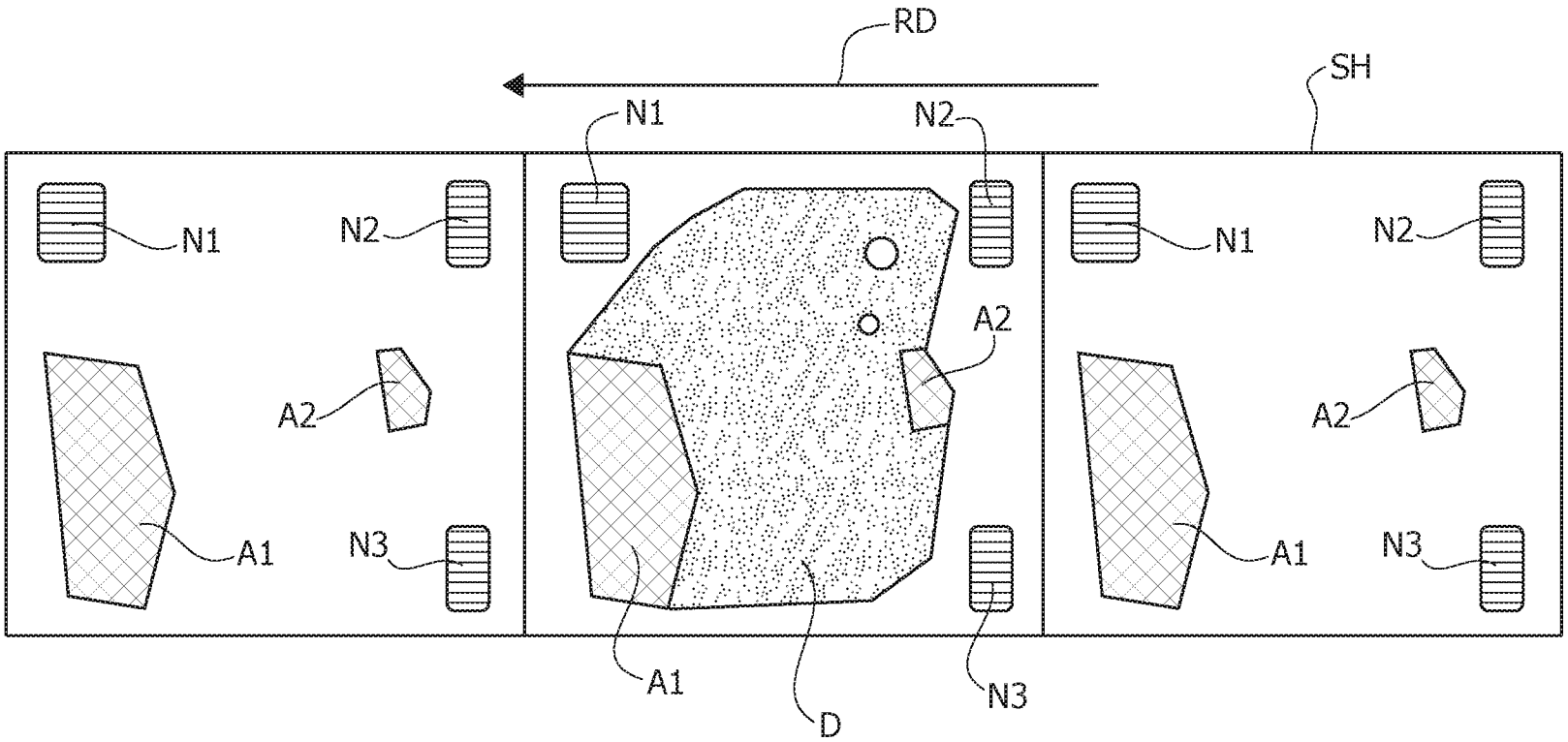
FIG. 6 is a schematic view of a further embodiment of the method according to the invention, this time illustrated applied to a different motor-vehicle component.

Finally, with reference to FIG. 6, a further embodiment of the method according to the invention is here illustrated applied to a second motor-vehicle component, in particular a door D. The door D, here visible in its plane development prior to shearing and pressing thereof, corresponds to a figure F arranged within which are a first area of increased thickness A1 and a second area of increased thickness A2, which define the first distribution. The area A1 is located in a region of the figure F that in the finished door is located at points of fixing of the hinges. The area A2 is instead located in a region of the figure F that corresponds to a lock of the door. The thicknesses of rolling considered—purely by way of example—for this application are 1 mm for the areas rolled to a nominal thickness, and 2 mm for the areas of increased thickness.

As regards the second distribution, it comprises three areas of increased thickness N1, N2, N3, where—with respect to the direction of rolling RD—the areas N2 and N3 are substantially located in the area A2, whereas the area N1 is substantially located in the area A1.

In this case, the following relation applies:

$$\Delta V''_{TOT}=(V''_{N1}-V0''_{N1})+(V''_{N2}-V0''_{N2})+(V'_{N3}-V0''_{N3})$$
$$\geq\Delta V'_{TOT}=(V'_{A1}-V0'_{A1})+(V'_{A2}-V0'_{A2})$$

where:

$\Delta V'_{TOT}$ is the overall increase in volume of the first distribution; and $\Delta V''_{TOT}$ is the overall increase in volume of the second distribution. The index i spans the areas A1, A2, and the index j spans the areas N1, N2, N3.

The person skilled in the art will appreciate that the method according to the invention makes it possible to obtain any distribution of areas of increased thickness within the figure F corresponding to the plane development of a motor-vehicle component, without being tied down to any particular geometry. It is thus possible to distribute the areas of increased thickness with function of structural reinforcement as and where necessary, without resorting to compromises that are far from acceptable from the standpoint of styling or as regards waste of material, which is, instead, practically inevitable with traditional tailored rolled blanks. This is achieved simply by taking care to prearrange a second distribution of areas of increased thickness with a compensation function.

Simply by respecting the criterion whereby the overall increase in volume of the second distribution is greater than or equal to the overall increase in volume of the first distribution, it is possible to impress any distribution of areas of increased thickness on the metal sheet SH, in particular within the figure F. Both of the distributions may comprise one or more areas, and the increased thicknesses may differ from one distribution to the other or even within one and the same distribution. It should, however, be noted that the shape, size, location, and thickness of the areas of the first distribution is principally dictated by the structural loads, according to design, of the component that is to be produced, whereas the shape, size, location, and thickness of the areas of the second distribution may basically be chosen as a function of the dual need to satisfy the aforesaid relation between the overall increases in volume of the first and second distributions and to place the areas outside the figure.

Furthermore, it should be noted that in the embodiments of FIGS. 2 and 5, it is preferable for the distributions of areas of increased thickness an additional criterion of sizing that consists in the constancy of the rate of flow of rolled material across the metal sheet.

In other words, in these embodiments, the two distributions of areas develop seamlessly in a single figure of constant increased thickness (the band BD or the polygonal band appearing in FIG. 5). Whenever a metal sheet is rolled with rolls with a surface relief corresponding to the shape of the aforesaid figure of increased thickness, there will always be two areas of interface corresponding to the perimeter of the figure F in question.

The shape of the figure F of increased thickness and the gradient of rolling thickness with respect to the rest of the metal sheet (namely, the difference between the increased rolling thickness and the nominal rolling thickness) can be chosen in such a way as to achieve a substantial constancy of the rate of flow of rolled material across the metal sheet astride of the areas of interface between the figure F of constant increased thickness and the remaining metal sheet.

In fact, starting from the assumption of a constant rate of rotation of the rolls, the rate of flow of rolled material is equal to the product between the rate of flow of the material and the rolling thickness (this applies to each point of the perimeter of the band BD). In particular, if S0 and S1 are the sections of flow corresponding to the nominal and increased thicknesses, respectively, and v0 and v1 are the corresponding rates of flow of the material in the areas with nominal and increased thickness, respectively, sizing of the band BD is made so as to respect the condition:

$$S0\cdot v0=S1\cdot v1$$

basically along the entire perimeter in order to minimise any distortion of the material. It should be noted that this is possible mainly in the embodiments of FIGS. 2 and 5 since they already in themselves tend to a behaviour aligned with the above condition.

In the embodiments of FIGS. 1, 3, 4, and 6, this condition is difficult to achieve on account of the discontinuous nature of the distributions of areas of increased thickness. It is hence preferable to adopt, at times, a further criterion of sizing of the areas of increased thickness of the first distribution M1, M2 and the areas of increased thickness of the second distribution N1, N2, or N1, N3, or N1, N2, N3, which are positioned and sized (shape and dimensions) so as to meet a criterion of constancy of the mean rate of flow of the rolled material across the metal sheet (transverse direction).

Of course, the details of construction and the embodiments may vary widely with respect to what has been described and illustrated herein, without thereby departing from the scope of protection of the present invention, as defined by the annexed claims.

What is claimed is:

1. A method for rolling metal sheets with variable thickness, the method including:

determining a first distribution of areas having an increased thickness with respect to a nominal rolling thickness of the sheet, said first distribution of areas including one or more first areas, said sheet being a single metal sheet, determining, for each first area of said first distribution, an increase of volume of material corresponding to a difference between a volume of material underlying each first area with the increased thickness assigned on the basis of said first distribution, and a volume of material underlying a corresponding area with the nominal rolling thickness, determining a second distribution of areas having an increased thickness with respect to the nominal rolling thickness, wherein said second distribution of areas includes one or more second areas, assigning, to each second area of said second distribution an increase of volume of material corresponding to a difference between a volume of material underlying each second area with the increased thickness assigned on the basis of said second distribution, and a volume of material underlying a corresponding area with the nominal rolling thickness, wherein an overall increase of volume of the one or more second areas of said second distribution is equal or higher to an overall increase of volume of the one or more first areas of said first distribution, positioning the one or more first areas of said first distribution along said sheet in a desired position within a figure that corresponds to a plane development of a component of a motor-vehicle which is to undergo a pressing operation, positioning the one or more second areas of said second distribution outside of said figure, providing a pair of mill rolls having a surface relief that corresponds, developed on a plane, to the combination of the first and the second distribution of areas with increased thickness, and rolling said metal sheet by means of said pair of mill rolls, wherein the one or more first areas of said first distribution are created with the one or more second areas of said second distribution.

2. The method according to claim 1, wherein the increased thickness of the first areas of the first distribution is identical to the increased thickness of the second areas of the second distribution.

3. The method according to claim 1, wherein the increased thickness of the first areas of the first distribution is different from the increased thickness of the second areas of the second distribution.

4. The method according to claim 3, wherein the first areas with increased thickness of the first distribution and/or the second areas with increased thickness of the second distribution have an increased thickness different within the distribution itself.

5. The method according to claim 1, wherein the first areas with increased thickness of the first distribution and the second areas with increased thickness of the second distribution are separate and distinct from each other.

6. The method according to claim 5, wherein the first areas with increased thickness of the first distribution and the second areas with increased thickness of the second distribution are arranged and dimensioned so as to satisfy a criterion of constancy of an average flow speed of the rolled material across the sheet.

7. The method according to claim 1, wherein the first distribution of areas with increased thickness and the second distribution of areas with increased thickness develop seamlessly with one another.

8. The method according to claim 7, wherein the first distribution of areas with increased thickness and the second distribution of areas with increased thickness develop seamlessly in a single figure having a constant increased thickness, wherein the shape of said figure having an increased thickness and the difference between the increased rolling thickness and nominal rolling thickness are chosen so as to achieve a substantial constancy of the flow rate of rolled material across the sheet astride of interface areas between said figure with constant increased thickness and remaining sheet.

9. The method according to claim 1, wherein a portion of the first areas with increased thickness of the first distribution and a portion of the second areas with increased thickness of the second distribution are separate and distinct to each other, while a remaining part of the first areas with increased thickness of the first distribution and a remaining part of the second areas with increased thickness of the second distribution extend seamlessly with each other.

10. The method according to claim 1, wherein the first areas with increased thickness of the first distribution and the second areas with increased thickness of the second distribution are provided by alignment of recesses having complementary shapes on the surface of said pair of mill rolls.

11. The method of claim 1, wherein the one or more first areas of said first distribution being created with the one or more second areas of said second distribution compensates for rolled material having a higher flow rate neighbouring the one or more first areas of said first distribution as compared to a slower flow rate of rolled material flowing into the one or more first areas of said first distribution, whereby said rolled material having the higher flow rate is configured to flow into the one or more second areas of said second distribution thereby slowing down and achieving a substantial constancy of a mean rate of overall flow of rolled material across the single metal sheet.

* * * * *